US010605127B2

(12) United States Patent
Benischek et al.

(10) Patent No.: US 10,605,127 B2
(45) Date of Patent: Mar. 31, 2020

(54) HYDRAULIC VALVE FOR A CAM PHASER

(71) Applicant: ECO Holding 1 GmbH, Marktheidenfeld (DE)

(72) Inventors: Günther Benischek, Illingen (DE); Mustafa Mohammed, Nürtingen (DE)

(73) Assignee: ECO Holding 1 GmbH, Marktheldenfeld (DE)

( * ) Notice: Subject to any disclaimer, the term of this patent is extended or adjusted under 35 U.S.C. 154(b) by 607 days.

(21) Appl. No.: 15/367,444

(22) Filed: Dec. 2, 2016

(65) Prior Publication Data

US 2017/0260883 A1 Sep. 14, 2017

(30) Foreign Application Priority Data

Mar. 14, 2016 (DE) ..... 10 2016 104 560

(51) Int. Cl.
*F01L 1/344* (2006.01)

(52) U.S. Cl.
CPC ..... *F01L 1/3442* (2013.01); *F01L 1/34409* (2013.01); *F01L 2001/34426* (2013.01); *F01L 2001/34433* (2013.01)

(58) Field of Classification Search
USPC ..... 123/90.12
See application file for complete search history.

(56) References Cited

U.S. PATENT DOCUMENTS 3,900,822 A 8/1975 Hardwick et al.
7,209,020 B2 4/2007 Telep
2006/0225791 A1 10/2006 Patze et al.
2009/0107433 A1 4/2009 Tanaka
2010/0300388 A1 12/2010 Lang et al.
2012/0073535 A1* 3/2012 Hoppe ..... F01L 1/34 123/188.4
2013/0019830 A1 1/2013 Hoppe et al.
2016/0024978 A1* 1/2016 Lichti ..... F01L 1/34409 123/90.15

FOREIGN PATENT DOCUMENTS

DE 102005048732 A1 4/2007
DE 602005000504 T2 11/2007
DE 102009022869 A1 12/2010
DE 102010022896 A1 8/2011
DE 102014101236 A1 8/2015
EP 2977569 A1 1/2016

OTHER PUBLICATIONS

Translation of DE 102010022896. Dec. 8, 2011.*

* cited by examiner

*Primary Examiner* — Mark A Laurenzi
*Assistant Examiner* — Mickey H France
(74) *Attorney, Agent, or Firm* — Von Rohrscheidt Patents

(57) ABSTRACT

A hydraulic valve, in particular for a phaser of a cam shaft, the hydraulic valve including a bushing including a piston that is displaceable in a bore hole along a longitudinal direction; a supply connection configured to supply a hydraulic fluid; at least a first operating connection and a second operating connection; and at least one tank drain configured to drain the hydraulic fluid, wherein the first operating connection and the second operating connection are alternatively connectable with each other and/or with the supply connection and/or with the at least one tank drain through at least one check valve by displacing the piston.

15 Claims, 9 Drawing Sheets

HYDRAULIC VALVE FOR A CAM PHASER

RELATED APPLICATIONS

This application claims priority from and incorporates by reference German Patent Application DE10 2016 104 560.8 filed on Mar. 14, 2016.

FIELD OF THE INVENTION

The invention relates to a hydraulic valve, in particular for a cam phaser of an internal combustion engine of a motor vehicle.

BACKGROUND OF THE INVENTION

DE 60 2005 000 504 T2 discloses a hydraulic slide piston valve for a variable cam phaser, the hydraulic valve including a plurality of check valves and channels extending from an advance chamber and a retard chamber to an opening in the slide piston. The piston which includes at least two slide elements that are separated from each other by a center bar is supported axially movable within a bore hole in the rotor. When the piston is in the first position hydraulic fluid flows from the advance chamber through the channel and the opening to a bore hole enveloping the center bar of the slide piston and through a check valve and the opening to the channel to the retard chamber. When the piston is in the second position hydraulic fluid flows from the retard chamber through the channel and the opening to the bore hole enveloping the center bar of the piston slide and through a check valve and the opening to the channel to the advance chamber.

BRIEF SUMMARY OF THE INVENTION

Thus, it is an object of the invention to provide a hydraulic valve which has a simple and compact configuration and which facilitates good control properties of a cam phaser.

It is another object of the invention to provide a cam phaser that has a simple and compact configuration and which provides good control properties.

The object is achieved by a hydraulic valve, in particular for a phaser of a cam shaft, the hydraulic valve including a bushing including a piston that is displaceable in a bore hole along a longitudinal direction; a supply connection configured to supply a hydraulic fluid; at least a first operating connection and a second operating connection; and at least one tank drain configured to drain the hydraulic fluid, wherein the first operating connection and the second operating connection are alternatively connectable with each other and/or with the supply connection and/or with the at least one tank drain through at least one check valve by displacing the piston, wherein the at least one check valve is arranged in an inner portion of the piston, wherein the at least one check valve includes a band shaped flexible element and releases a connection between an outside of the piston and the inner portion of the piston in an open position of the at least one check valve, and wherein an inside of the piston includes an outer stop for the at least one check valve so that the band shaped flexible element is openable in an inward direction by a hydraulic pressure provided at the outside of the piston, in particular a pulsating hydraulic pressure.

The object is also achieved by a phaser for a cam shaft, the phaser comprising the hydraulic valve described supra, wherein the first operating connection is connected with the first pressure chamber of the phaser and the second operating connection is connected with the second pressure chamber of the phaser, wherein the first operating connection and the second operating connection are alternatively connectable with each other and/or with the supply connection and/or with the at least one tank drain through at least one check valve by displacing the piston, wherein the at least one check valve is arranged in an inner portion of the piston, wherein the at least one check valve includes a band shaped flexible element and releases a connection between an outside of the piston and an inner portion of the piston in an open position of the at least one check valve, and wherein an inside of the piston includes an outer stop for the at least one check valve so that the band shaped flexible element is openable in an inward direction by a hydraulic pressure provided at the outside of the piston, in particular a pulsating hydraulic pressure.

Advantageous embodiments and advantages of the invention can be derived from the dependent claims, the description and the drawing figures.

A hydraulic valve is proposed, in particular for a cam phaser, the hydraulic valve including a bushing with a piston that is arranged axially moveable in a bore hole along a longitudinal direction, a supply connection for feeding a hydraulic fluid, at least a first operating connection and a second operating connection and at least one tank drain for draining the hydraulic fluid. The first operating connection and the second operating connection are alternatively connectable with one another and/or with the supply connection and/or the at least one tank drain by displacing the piston through at least one check valve. The at least one check valve is arranged in an interior portion of the piston. The at least one check valve includes a band shaped flexible element and opens a connection between an outside of the piston and an inner portion of the piston in an open position of the check valve. An inside of the piston includes an outer stop for the check valve so that the element can be opened towards an inside by a hydraulic pressure provided at an outside of the piston, in particular a pulsating hydraulic pressure.

Pulsating hydraulic pressures are provided by switching torques at the hydraulic piston which can have a variable positive or negative value as a function of timing. By comparison surging torques are torques which change their amounts but which remain in the same prefix range of the torque curve over a longer time period of several milliseconds.

A hydraulic loop of a cam phaser of a motor vehicle with a double acting hydraulic piston with at least two hydraulic chambers is impacted by an external torque which is either alternating or surging in size. The hydraulic loop performs position changes by variable pressure loading of the double acting hydraulic chambers through a hydraulic pump. In addition to hydraulic switching, advantageously implemented by a valve which conducts the hydraulic fluid to the piston a negative portion of the alternating torque is used to change a position of the hydraulic piston. The surging portion of the torque, however, is cut out by additional means like e.g. check valves. Selectively using torques, in particular through a release through check valves provides a linearization of an adjustment speed over an engine speed whereas a continuous use of a minimal hydraulic supply from a pump to adjust the piston assures the high adjustment speed when there are only surging portions of the torque.

For example hydraulic connections from one type of chamber to an operating connection of another type of chamber can be provided. This yields a hydraulic loop with a valve. The valve can pass the hydraulic pressure to the second operating connection of the other chamber type since pressure can be transferred from a negative portion of the switching torque from one operating connection of a first chamber type through at least one check valve. An alternating pass through can be provided. Otherwise the pressure loading of the pressure loaded connection is passed on to the second operating connection. The alternating pass through of the hydraulic medium has to be performed from the first chamber and also from the second chamber to the corresponding counteracting chamber. The function of the check valves can be designated as a bypass which only feeds back a negative portion of the alternating force upstream of the cam phaser. A suitable location for the feedback can be the supply connection of the cam phaser. The check valve or the check valves when plural check valves are provided can be arranged so that a pass through of the hydraulic pressure from the chambers of the piston is only facilitated in a direction to the pressure side of the cam phaser.

The at least one check valve of the hydraulic valve is arranged in an inner portion of the piston in order to facilitate a very compact configuration of the hydraulic valve. In particular the check valve is provided as a band check valve which includes a band shaped flexible element, for example a ring shaped overlapping band made from spring steel as a closing element of the check valve. A flexible band of this type has the necessary spring tension to put up resistance against an external hydraulic pressure so that the band only yields when a predetermined pressure threshold is exceeded, cambers inward and opens the valve cross section. The pressure threshold can thus be adjusted by selecting the material and the strength of the material. The inside of the piston represents an outer stop for the band where the band contacts as long as the hydraulic pressure below the pressure threshold and the check valve is closed. When the pressure threshold is exceeded the band lifts off from the stop in an inward direction and opens the valve cross section in the inward direction so that hydraulic fluid can flow from an outside of the piston into an inner portion.

Since the check valve is opened in inward direction by the hydraulic pressure of the chamber of the cam phaser that is to be emptied the hydraulic pressure is maintained in the chamber to be emptied. Thus, the chamber to be emptied is cut off by the check valve and cut off from incoming hydraulic fluid. Thus the check valve prevents a movement of the piston of the hydraulic valve caused by a pressure spike.

This function of the check valve in the interior portion of the piston implements an improved control quality of the hydraulic valve with a particularly compact and economical configuration of the hydraulic valve. A risk that a flow of the hydraulic fluid through the check valve is blocked is reduced. A check valve of this type with a band shaped flexible element opens better than comparable check valves and closes more quickly. Through this check valve the hydraulic valve can effectively use the pulsating hydraulic pressure for the function of the connected cam phaser.

According to an advantageous embodiment a respective check valve in an inner portion of the piston can respectively be associated with the first operating connection and the second operating connection. This way pressure pulses on the first operating connection and also on the second operating connection can respectively open associated check valves in an inward direction so that the pressure pulses are forwarded to the second or the first operating connection in order to advantageously use the function of the switching torques for adjusting the cam phaser.

According to an advantageous embodiment a first operating position of the hydraulic valve can be provided in which a first fluid path of the hydraulic fluid from the first operating connection through the check valve associated with the first operating connection to the second operating connection is open and a second operating position can be provided in which a second fluid path of the hydraulic fluid from the second operating connection through the check valve associated with the second operating connection to the first operating connection is open. This way a hydraulic pressure in the first operating position of the hydraulic valve can be passed through directly from the first operating connection to the second operating connection whereas in the second operating position the hydraulic pressure can be passed through directly from the second operating connection to the first operating connection which provides quick control properties for the hydraulic valve.

According to an advantageous embodiment a third so called center position of the hydraulic valve can be provided in which the first operating connection and the second operating connection are closed independently from the check valves and are not connected with the check valves. In this center position the check valves and the chambers of a connected cam phaser are closed and sealed relative to each other. This third position thus corresponds to a check position or center position of the hydraulic valve.

According to an advantageous embodiment an additional fluid path of the hydraulic fluid can be provided from an outside of the piston to the at least one check valve through bore holes in the piston. The hydraulic fluid can press on the band shaped flexible element of the check valve through the bore holes in the wall of the piston and can thus open the check valve in an inward direction. This way the band can contact the stop at the inside of the piston and is pressed only by the hydraulic pressure from an outside inward and thus opened.

According to an advantageous embodiment a radial circumferential control groove that is at least partially provided on the outside of the piston can be used for supplying the bore holes with the hydraulic fluid. Thus, it can be provided that prevalent hydraulic pressure impacts the outside of the piston in the same radial circumferential manner and the hydraulic pressure does not initiate any rotation of the piston. Through the control groove the hydraulic pressure can be passed through the bore holes in the wall of the piston and onto the band of the check valve and actuate the check valve.

According to an advantageous embodiment the outside of the piston in the portion of the bore holes can be configured as a flat surface portion. In an alternative embodiment the outside of the piston can be configured as a flat surface in sections which are flat sections of the cylindrical outer wall of the piston which are adjacent to each other in the circumferential direction. The surface proportions are advantageous balanced so that the impacting hydraulic pressure does not rotate or axially move the piston. Advantageously each surface is provided with a bore hole for supplying the check valve with the hydraulic pressure.

According to an advantageous embodiment the band shaped flexible element can be secured by a fixation element that envelops the flexible element in an axial direction to prevent a displacement of the flexible element in a longitudinal direction. The band shaped flexible element is thus retained in an axial position and can only move in the radial direction due to the impacting hydraulic pressure in order to open the check valve in an inward direction or in order to close the check valve through reapplication to the inside of the piston. Thus, the check valve as a whole is fixated in an inner portion of the piston.

According to an advantageous embodiment the check valve can be configured with at least one sleeve as an integral unit which includes the band shaped flexible element and the fixation element, wherein the band shaped flexible element contacts an inside of the sleeve with a preload. This way the check valve can be preassembled as a module and can be arranged in an inner portion of the piston at a desirable axial position quite easily. Thus, also the stop of the band shaped flexible element depending on the configuration of the band can be at least predetermined by the inside of the sleeve. Mounting the check valve in the piston is very much facilitated by this solution. Advantageously also two sleeves can be provided which envelop the band from both sides in the longitudinal direction.

According to an advantageous embodiment the band shaped flexible element can be arranged in a bore hole of the piston and secured by at least one annular fixation element against a displacement in the longitudinal direction. Alternatively it is also possible that the band is arranged directly in an inner portion of the piston and only secured by a fixation element in the axial direction so that the band cannot move in the axial direction also in the function as a check valve when it is pressed in the inward direction. Thus, the annular fixation element is provided with a particular thickness or with radially extending fixation elements and/or the annular fixation element includes an inner stop which prevents that the band is moved beyond the annular fixation element in an axial direction.

According to an advantageous embodiment the fixation element can be configured cylindrical or hollow cylindrical and can include two axially offset portions with radially extending protrusions, wherein the band shaped flexible element is arranged about the fixation element and between the two portions and is fixated by the protrusions on the fixation element in an axial direction. The radially extending protrusions can be configured as bars or teeth which axially fixate the band and which are oriented in front and after the band in radially outward direction or radially inward direction. Already one respective protrusion in front and after the band can perform this function. For reasons of symmetry it is advantageous to provide 3 or more protrusions on the fixation element.

According to an advantageous embodiment the fixation element can form a stop for the band shaped flexible element in an inward direction. The stop in the inward direction can cause a limitation of the acting hydraulic pressure which is forwarded from one operating connection to the respective other operating connection. This way stable mounting of the band shaped flexible element in the integrated unit of the check valve is provided and the position of the band is also maintained for higher pressure spikes.

According to an advantageous embodiment the radially extending protrusions can be provided for supporting the at least one sleeve. The sleeve can be supported by the radially extending protrusions in the axial direction and in the radial direction which helps forming a mounting unit for the check valve. Thus, the fixation element can also be firmly fixated in the sleeve itself.

According to an advantageous embodiment another check valve with a band shaped flexible element can be provided at the supply connection within the piston wherein the additional check valve can be opened in the inward direction by a hydraulic pressure acting at the supply connection. A check valve at the supply connection can provide that the supply pressure of the hydraulic fluid is kept constant and pressure spikes from the operating connections do not propagate to the supply connection but at the most can cause a draining of the hydraulic fluid into the tank drain.

According to another aspect the invention relates to a cam phaser including a hydraulic valve wherein a first operating connection is connected with a pressure chamber of a cam phaser and a second operating connection is connected with a second pressure chamber of the cam phaser. The first operating connection and the second operating connection are alternatively connectable with one another and/or with the supply connection and/or with the at least one tank drain through at least one check valve by displacing the piston. The at least one check valve is arranged in an interior portion of the piston. The check valve includes a band shaped flexible element and releases a connection between an outside of the piston and its inside in an open position, wherein the inside of the piston includes an external stop for the check valve, so that the element is openable inward by a hydraulic pressure prevailing at an outside of the piston, in particular a pulsating hydraulic pressure.

The hydraulic valve shall pass the torque variations in particular of the cam phaser which can occur as alternating torques as well as swelling torques with identical prefix through together with the hydraulic pressure from the supply connection. Operating connections that lead to the chambers of the hydraulic piston are alternatively switched through or interrupted as a function of the hydraulic piston within the valve. Without torque variations the valve conducts the hydraulic pressure temporarily in one of the chambers of the cam phaser. In the hydraulic loop another hydraulic pressure is generated which originates from the negative portion of the alternating torque. The hydraulic pressure which is caused by the negative portion of the alternating torque can always be run out through at least one check valve. The run out pressure is passed through to the second operating connection. The described condition is a special condition because most of the time the pressure loading which comes from the supply connection is forwarded to the respective operating connection. Pressures within the hydraulic loop that exceed the permanent pressure are being used. The bypass conduit from the check valve uses the negative toque, whereas the standard distribution is assured by the selected standard position of the hydraulic piston. In addition to an advantageous use of additional pressure resources this back feed improves control quality and even smooths and improves adjustment speed.

In particular for passing the negative portion of the alternating torque through two check valves are being used. The check valves are arranged so that they prevent a flow of hydraulic medium from the supply connection to the operating connection when a pressure resulting from an absolute amount of the negative portion of the alternating torque exceeds an absolute amount of the pressure of the supply connection. The valves function as directional throttles.

BRIEF DESCRIPTION OF THE DRAWINGS

Further advantages can be derived from the subsequent drawing description. The drawings illustrate embodiments of the invention. The drawings, the description and the claims include several features in combination. A person skilled in the art will advantageously view the features individually and combine them into additional useful combinations, wherein:

DETAILED DESCRIPTION OF THE INVENTION

Figure 1:
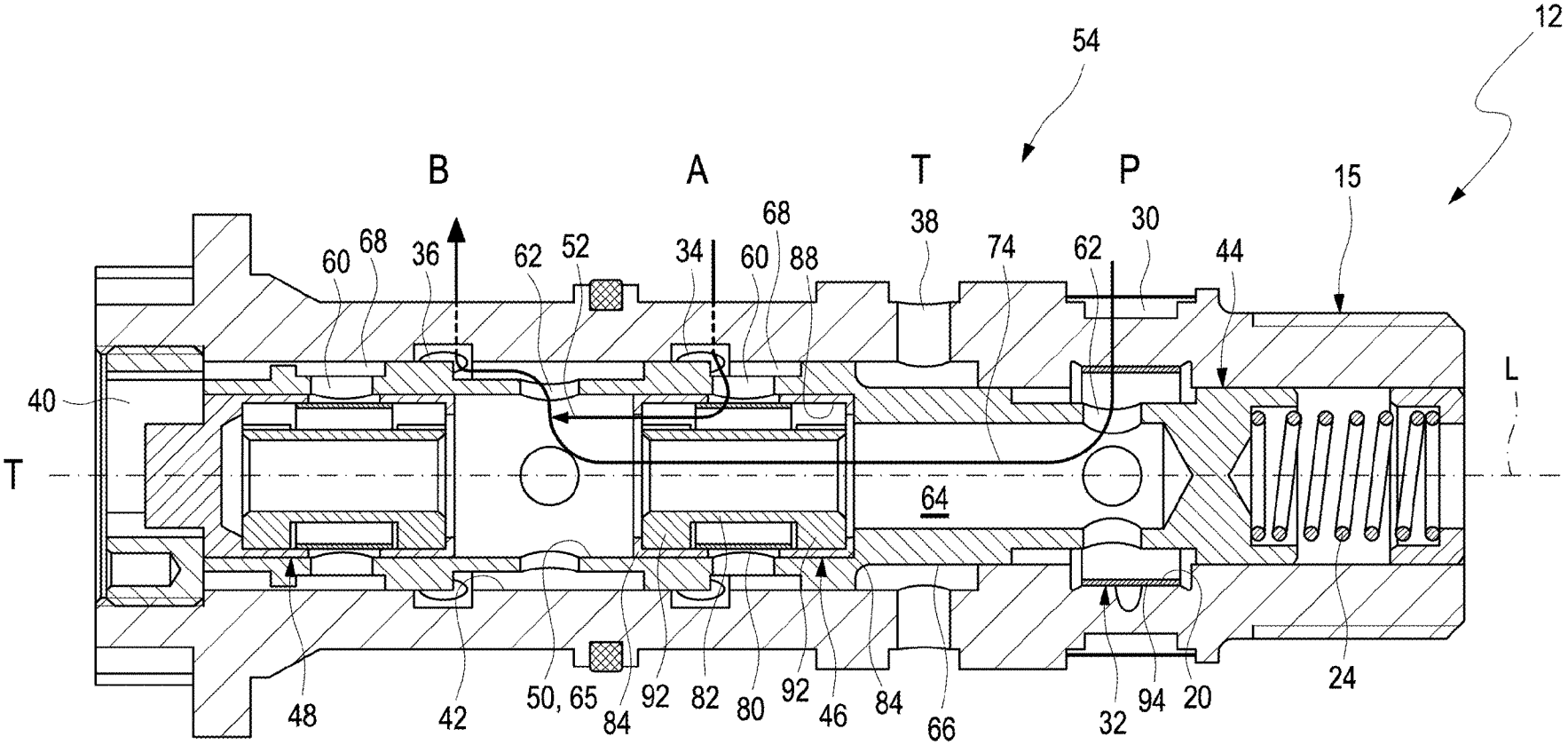
FIG. 1 illustrates a hydraulic valve for adjusting a cam phaser according to an embodiment of the invention in a first operating position in a longitudinal sectional view.

In the figures identical or like components are designated with identical reference numerals. The figures only illustrate exemplary embodiments and do not limit the scope and spirit of the invention.

FIG. 1 illustrates a hydraulic valve 12 for adjusting a cam phaser 14 according to an embodiment of the invention in a first operating position 54 in a longitudinal sectional view. The hydraulic valve 12 includes a bushing 15 with a piston 44 that is arranged in a bore hole 42 so that it is moveable in a longitudinal direction L. The piston 44 is supported at the bushing 15 by a compression coil spring 24.

The bushing 15 includes a supply connection 30 for feeding a hydraulic fluid, a first operating connection 34, a second operating connection 36, and two tank drains 38, 40 for draining the hydraulic fluid. The first operating connection 34 and the second operating connection 36 are alternatively connectable with one another and/or with the supply connection 30 and/or with the at least one tank drain 38, 40 through at least one check valve 46, 48 by moving the piston 44. The two check valves 46, 48 are arranged in an inner portion 64 of the piston 44. The check valves 46, 48 include a band shaped flexible element 80 which releases a connection between the outside 66 of the piston 44 and its inner portion 64 in an open position. The inside 65 of the piston 44 includes an outer stop for the check valves 46, 48 so that the element 80 is openable towards an inside by a hydraulic pressure provided at an outside 66 of the piston 44, in particular a pulsating hydraulic pressure. A respective check valve 46, 48 is associated with the first operating connection 34 and the second operating connection 36 in the inner portion 64 of the piston 44. At the supply connection 30 another check valve 32 with a band shaped flexible element 94 is provided within the piston 44. Also this check valve 32 is openable in inward direction by a hydraulic pressure provided at the supply connection 30. The band shaped flexible element 94 contacts an inner wall 20 of the bushing 15 when this check valve 32 is without pressure in a closed condition of the check valve 32.

The check valve 46, 48 includes a fixation element 82 which is configured as a hollow cylinder with laterally extending protrusions 92. The band shaped flexible element 80 is axially fixated between the protrusions 92 and can only move in a radial direction. Two sleeves 84 envelop the fixation element 82 from both ends and are supported by the protrusions 92, wherein the band shaped flexible element 80 is preloaded and partially contacts an inside 88 of the sleeve 84 and thus closes the check valve 46, 48 in a condition without pressure. Thus, the check valve 46, 48 is configured as a preassembled integrated unit 86 which can be advantageously mounted in the inner portion 64 of the piston 44 in its entirety.

In FIG. 1 the hydraulic valve 12 is illustrated in a first operating position 54 in which a first fluid path 52 of the hydraulic fluid from the first operating connection 34 through the hydraulic valve 46 associated with the first operating connection 34 to the second operating connection 36 is open. The check valve 46 can be opened by the hydraulic pressure provided at the first operating connection 34. In the drawing of FIG. 1 the check valve 46 itself, however, is illustrated in the closed condition with the contacting band shaped flexible element 80. Also the fluid path 74 from the supply connection 30 through the inner portion 64 of the piston 44 to the second operating connection 36 is open.

Figure 2:
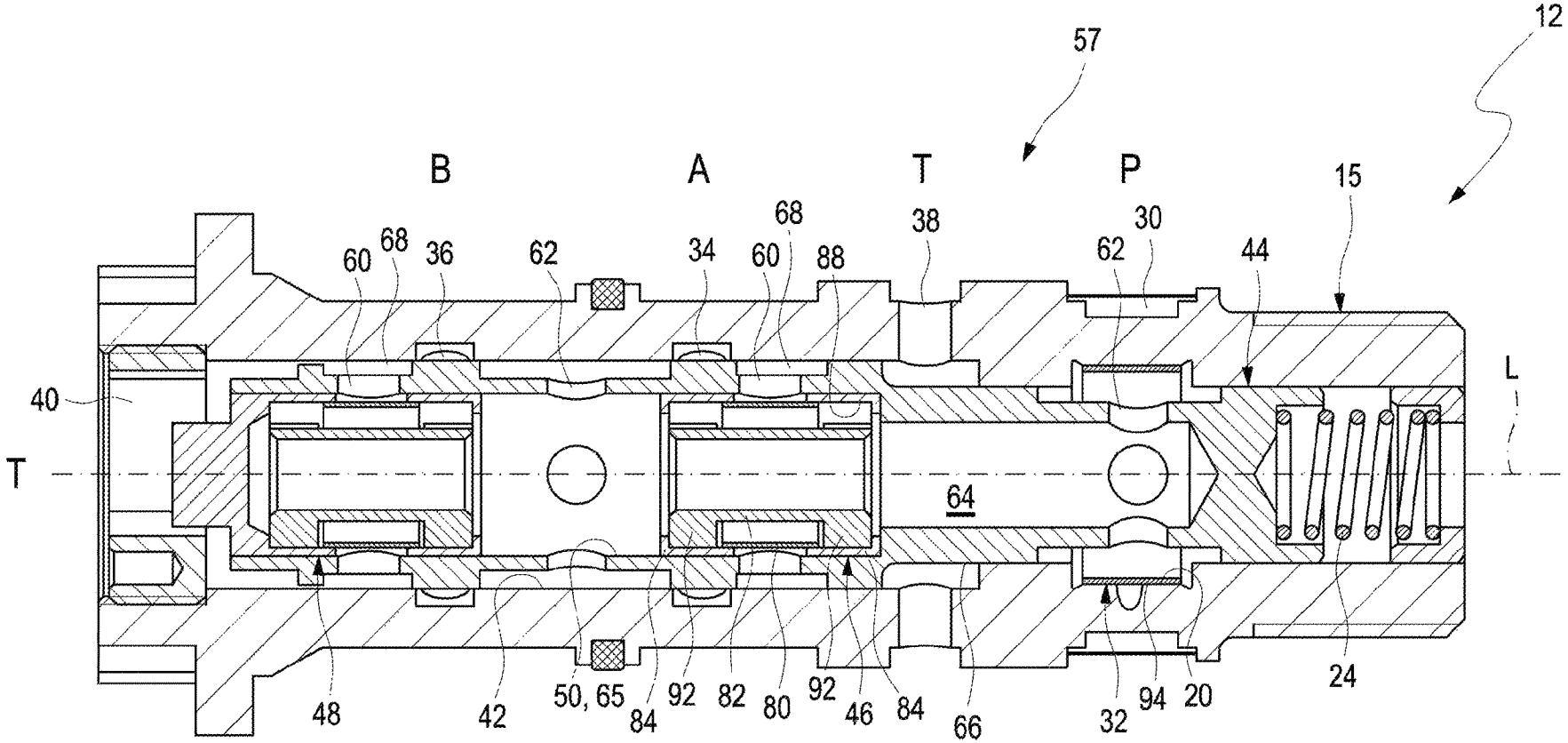
FIG. 2 illustrates the hydraulic valve according to FIG. 1 in a center position.

FIG. 2 illustrates the hydraulic valve 12 according to FIG. 1 in a center position 57 in which the first operating connection 54 and the second operating connection 36 are closed independently from the check valves 46, 48. Both operating connections 34, 36 are closed by the control piston 44 so that no connection is provided between the two operating connection 34, 36 and the check valves 46, 48.

Figure 3:
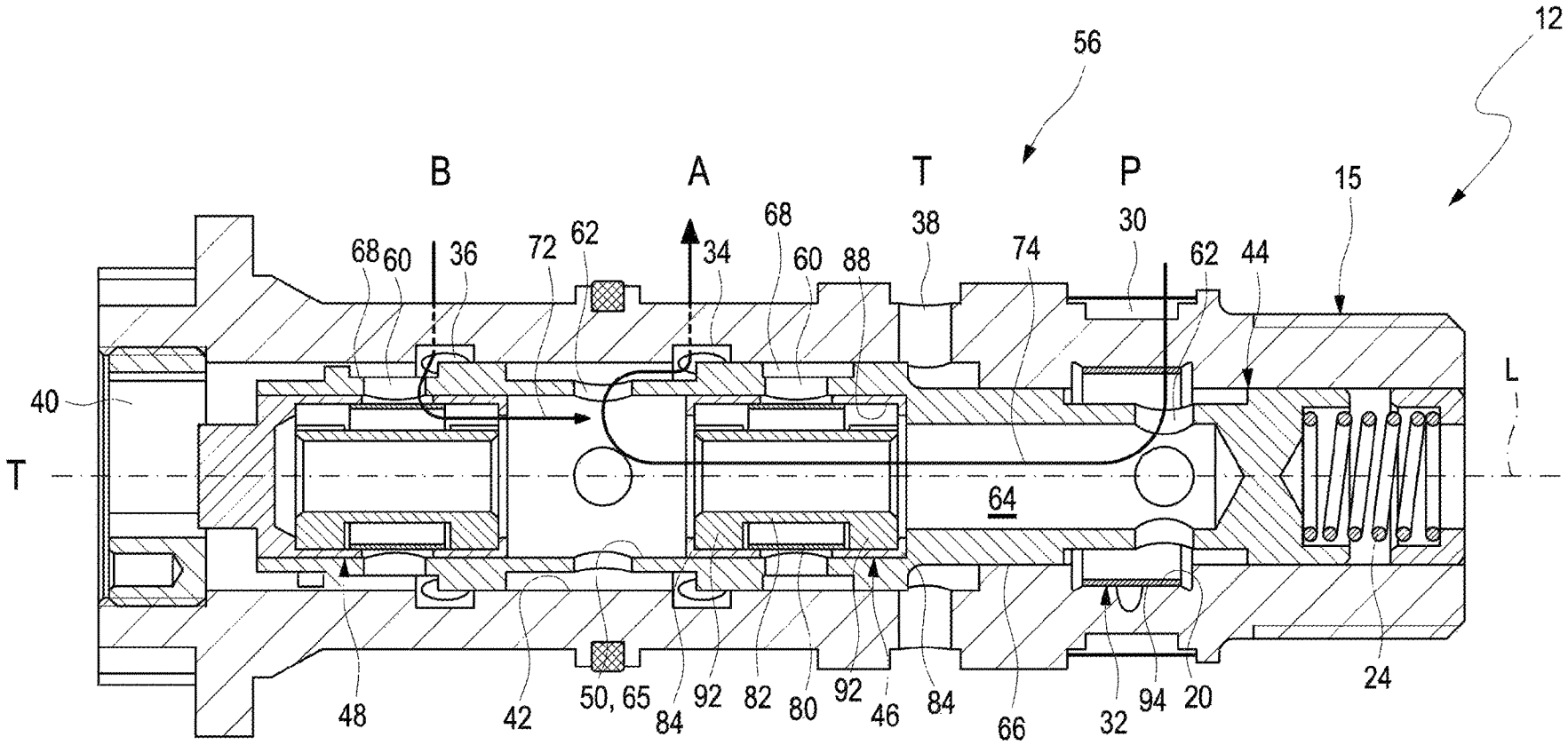
FIG. 3 illustrates the hydraulic valve according to FIG. 1 in a second operating position.

FIG. 3 illustrates the hydraulic valve 12 according to FIG. 1 in a second operating position 56 in which a second fluid path 72 of the hydraulic fluid from the second operating connection 36 through the check valve 48 associated with the second operating connection 36 to the first operating connection 3 is open. The check valve 48 can be opened by a hydraulic pressure provided at the second operating connection 36. FIG. 3 illustrates the check valve 48 in a closed condition with a contacting band shaped flexible element 80. Also the fluid path 74 from the supply connection 30 through the inner portion 64 of the piston 44 to the first operating connection is open.

Figure 4:
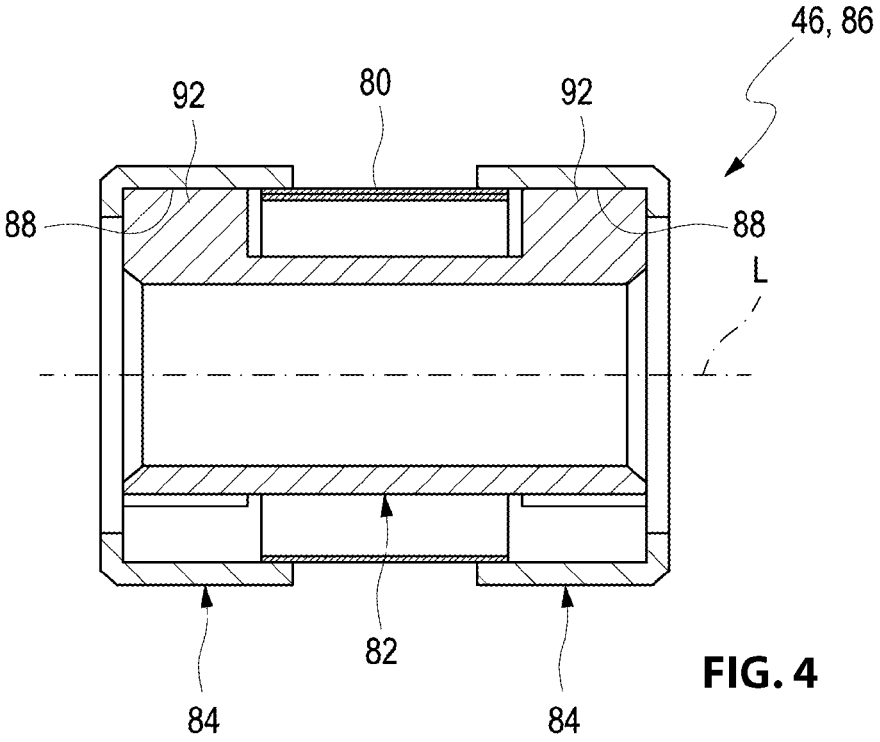
FIG. 4 illustrates the check valve according to an embodiment of the invention in a closed position in a longitudinal sectional view.

FIG. 4 illustrates a check valve 46 according to an embodiment of the invention in a closed position in a longitudinal sectional view. The check valve 46 includes the fixation element 82 which can be configured cylindrical or hollow cylindrical (in FIG. 4 it is configured hollow cylindrical) and includes two axially offset portions with radially extending protrusions 92. The band shaped flexible element 80 is arranged about the fixation element 82 and between the two portions and axially fixated by the two protrusions 92 on the fixation element 82. The band shaped flexible element 80 is secured against displacement in the longitudinal direction L by the fixation element 82 axially enveloping the band shaped flexible element 80.

Two sleeves 84 envelop the fixation element 82 from both sides and are supported by the protrusions 92, wherein the band shaped flexible element 80 is preloaded and partially contacts the inside 88 of the sleeve 84 and thus closes the check valve 46, 48 in a condition where no pressure is provided. The check valve 46, 48 is thus configured as a preassembled integrated unit 86 which can be advantageously mounted as a whole in the inner portion 64 of the piston 44. The band shaped flexible element 80 is preloaded and contacts the inside 88 of the sleeves 84 and can be opened from the outside by a hydraulic pressure. The fixation element 82 thus forms a stop for the band shaped flexible element 80 in an inward direction.

Figure 5:
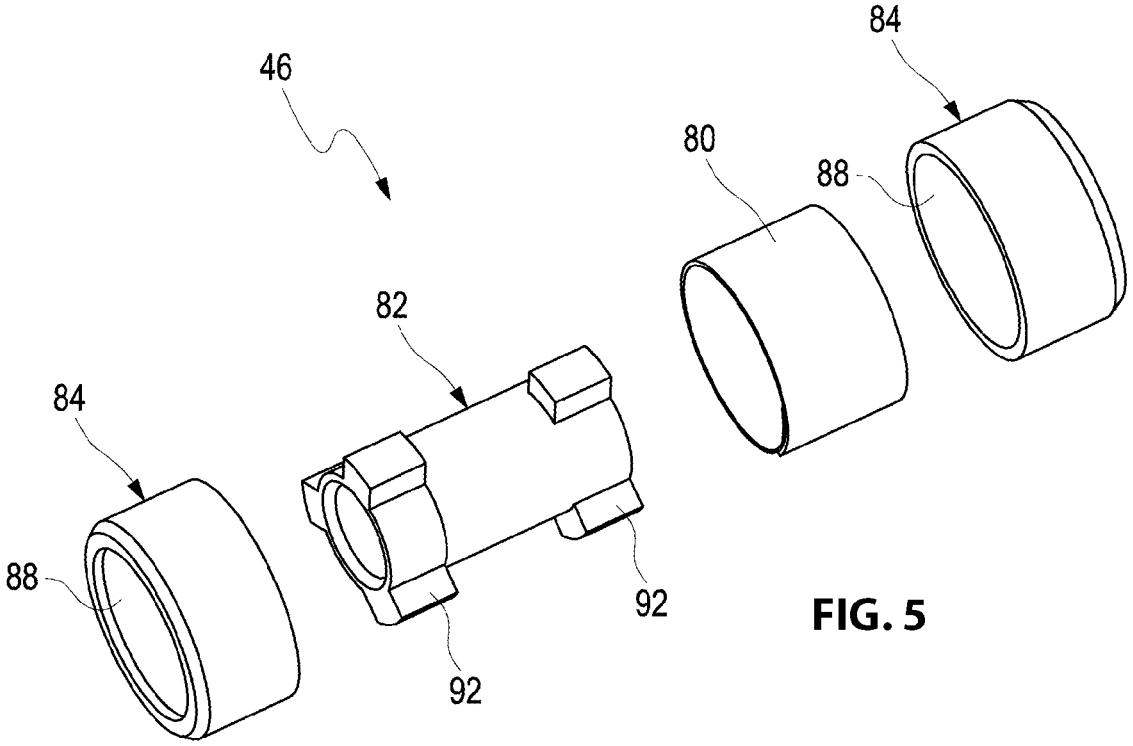
FIG. 5 illustrates the check valve according to FIG. 4 in an exploded view.

FIG. 5 illustrates the check valve 46 according to FIG. 4 in an exploded view. Thus the individual components of the check valve 46 are separately illustrated in an assembly sequence: the fixation element 82 is illustrated as a center component of the check valve 46, the band shaped flexible element 80 which is positioned between the protrusions 92 of the fixation element 82 and the two sleeves 84 which are subsequently slid onto the protrusions 92 of the fixation element 82 from both ends. The band shaped flexible element 80 is thus moved slightly inward so that the element 80 contacts an inside 88 of the sleeves 84 with a preload and closes the check valve 46 in a condition without pressure. In the embodiment in FIG. 5, three protrusions 92 are illustrated respectively evenly distributed over the circumference of the fixation element 82, however also four or more protrusions 92 can be provided. Less than three protrusions 92 are also possible as long as the sleeves 84 can thus be supported on the fixation element 82.

Figure 6:
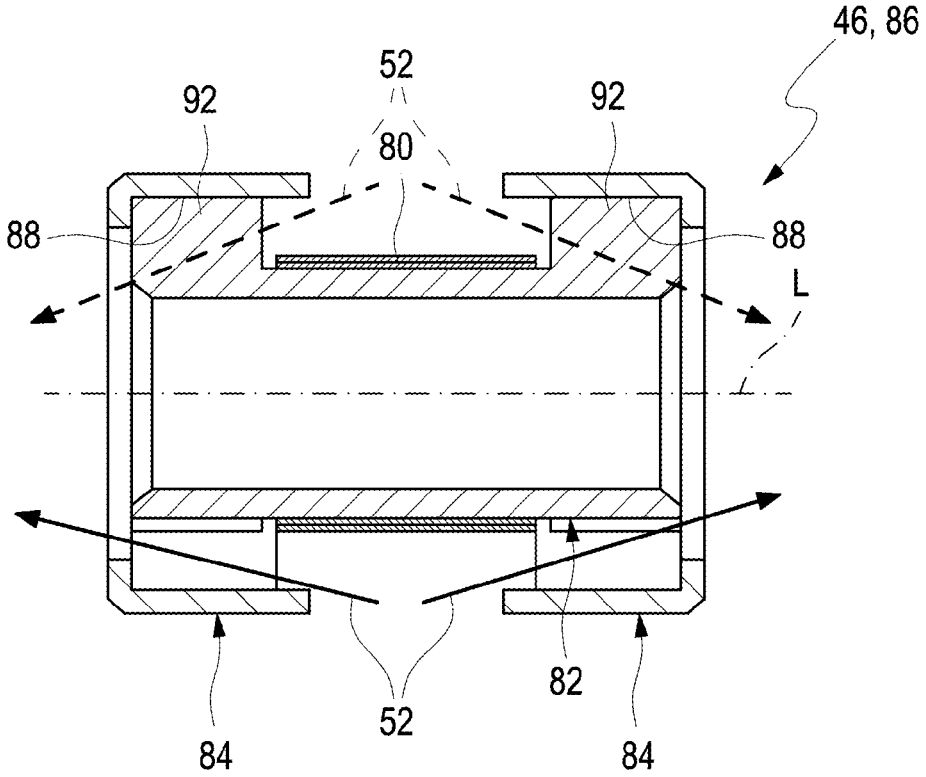
FIG. 6 illustrates the check valve according to FIG. 4 in an open position depicted in a longitudinal sectional view.

In FIG. 6 the check valve 46 is illustrated according to FIG. 4 in an open position in a longitudinal sectional view. The band shaped flexible element 80 is pressed inward by a hydraulic pressure applied on the outside and contacts the inner stop of the fixation element 82. The fluid paths 52 thus opened are illustrated in FIG. 6. The two upper fluid paths 52 are illustrated in dashed lines in the drawing since they extend in front or behind the drawing plane since the protrusions 92 are cut in the drawing plane.

Figure 7:
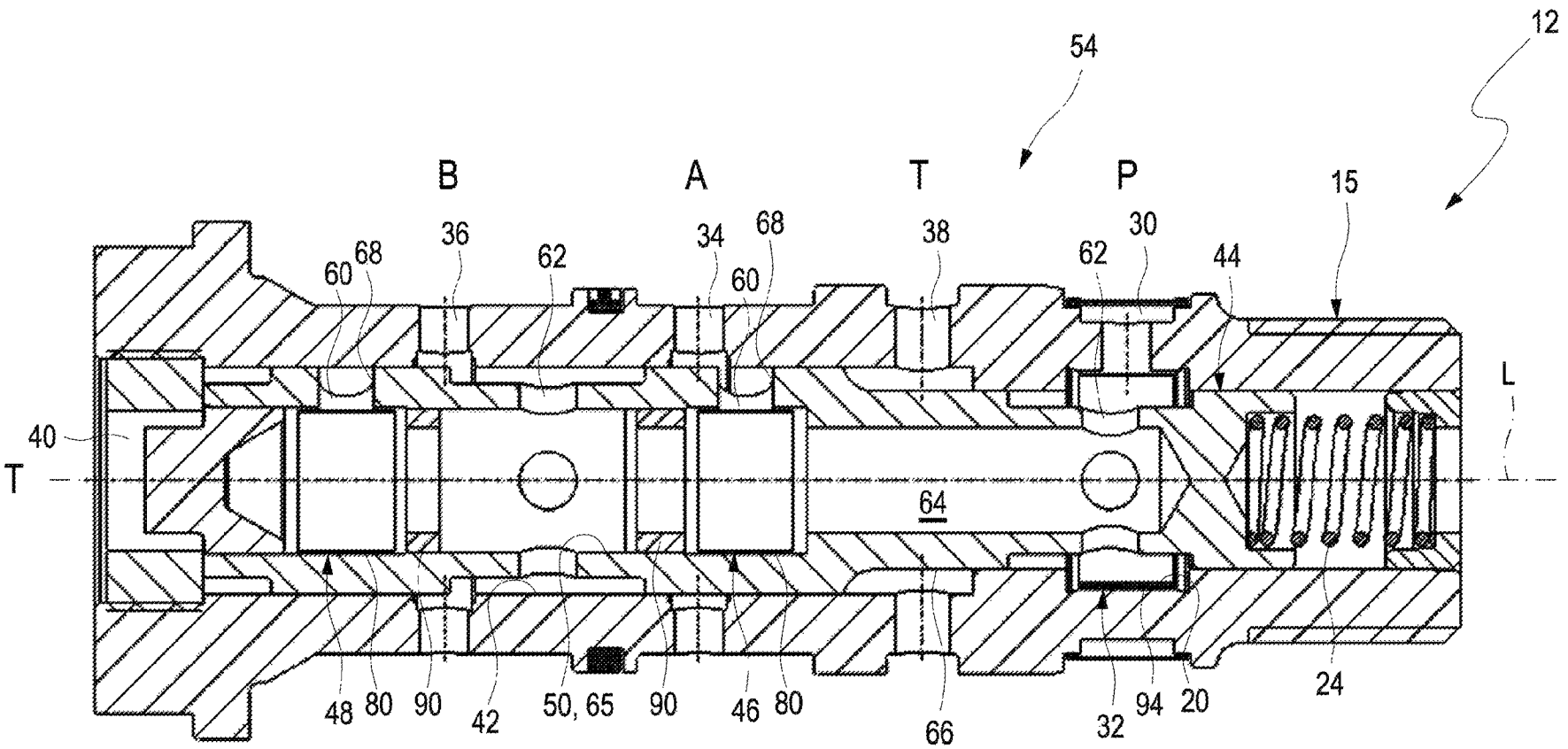
FIG. 7 illustrates the hydraulic valve according to another embodiment of the invention in a longitudinal sectional view.

FIG. 7 illustrates a hydraulic valve 12 according to another embodiment of the invention in a longitudinal sectional view. In this hydraulic valve 12 two check vales 46, 48 are inserted which merely include one band shaped flexible element 80 which is arranged in the bore hole 50 of the piston 44 and secured with at least one annular fixation element 90 against a movement in the longitudinal direction L. The band shaped flexible element 80 in this embodiment contacts in unpressurized thus closed condition of the check valve 46, 48 with a preload directly at the inside 65 of the inner portion 64 of the piston 44 on one side at a stop of the bore hole 50 and is secured by the annular fixation element 90 which is pressed for example into the bore hole 50 against a movement in the longitudinal direction L.

Figure 8:
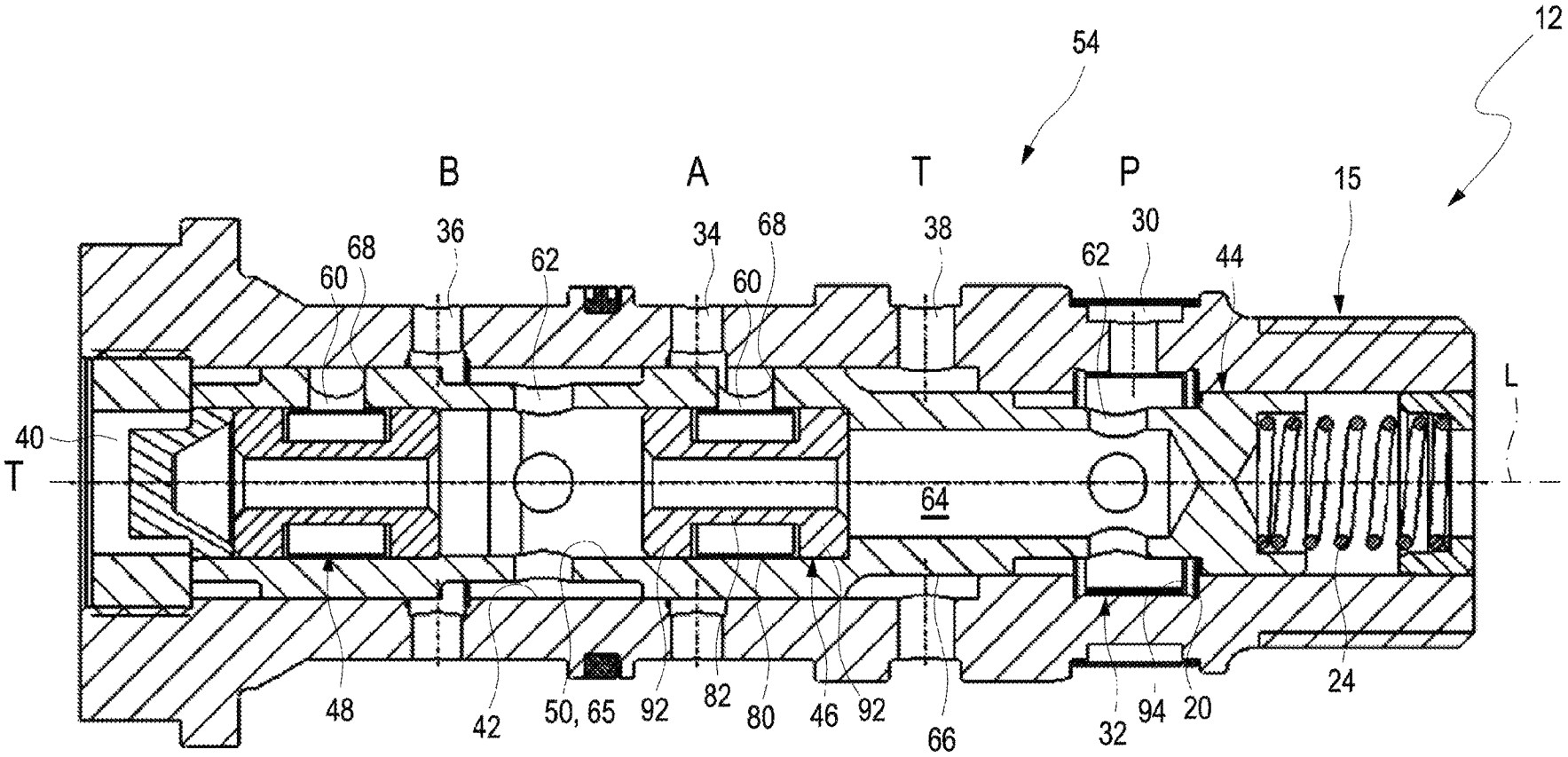
FIG. 8 illustrates the hydraulic valve according to another embodiment of the invention in a longitudinal sectional view.

FIG. 8 illustrates a hydraulic valve 12 according to another embodiment of the invention in a longitudinal sectional view. The check valves 46, 48 include fixation elements 82 similar to the check valve 46 illustrated in FIGS. 4 through 6, wherein the band shaped flexible element 80 is arranged between axially offset protrusions 92. In this embodiment, however, no sleeves 84 are being used, the fixation element 82 is pressed directly into the bore hole 50 of the inner portion 64 of the piston 44 so that the band shaped flexible element 80 in non-pressurized, thus closed condition of the check valves 46, 48 directly contacts the inside 65 of the inner portion 64 with a preload.

Figure 9:
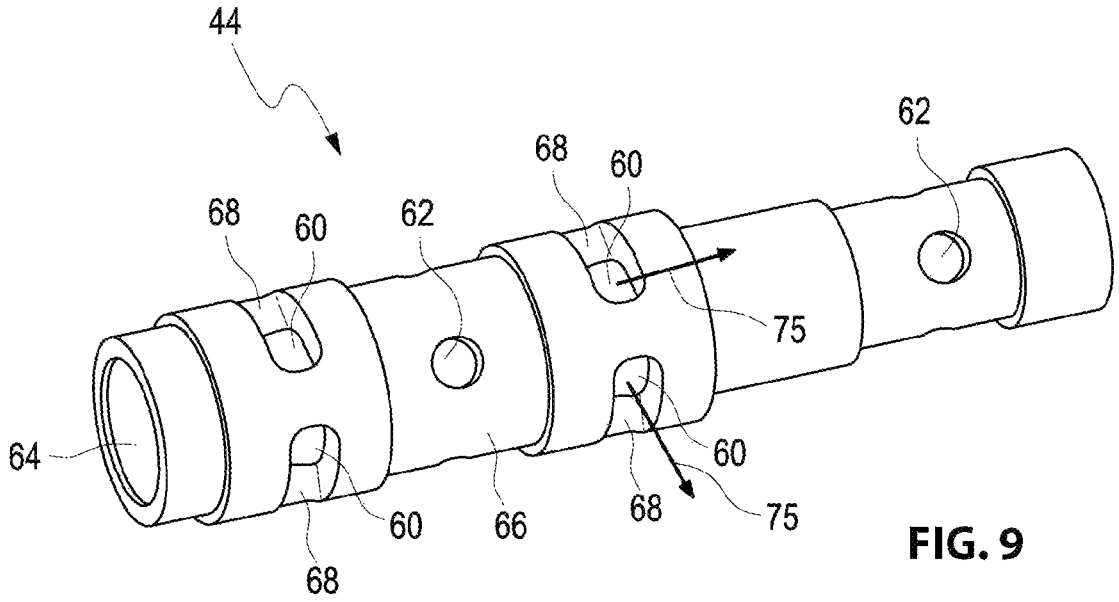
FIG. 9 illustrates a piston of a hydraulic valve according to an embodiment of the invention in an isometric view.

FIG. 9 illustrates a piston 94 of a hydraulic valve 12 according to an embodiment of the invention in an isometric view. The piston 44 includes bore holes 62 for hydraulically connecting the outside 66 of the piston 44 with the inner portion 64. The piston 44 furthermore includes bore holes 60 which provide another fluid path 75 of the hydraulic fluid from the outside 66 of the piston 44 to the check valves 46, 48 in the piston 44. Through these bore holes 60 the check valves 46, 48 arranged in an inner portion 64 of the piston 44 are loaded with hydraulic pressure. Since the piston 44 runs with a fit in the bore hole 42 of the bushing 15 of the hydraulic valve 12 a control groove 68 at least partially extending on an outside 66 of the piston 44 in a radial circumferential direction is provided for supplying the bore hole 60 with the hydraulic fluid so that the hydraulic fluid can penetrate on an outside 66 of the piston 44 through the control groove 68 into the bore holes 60.

Figure 10:
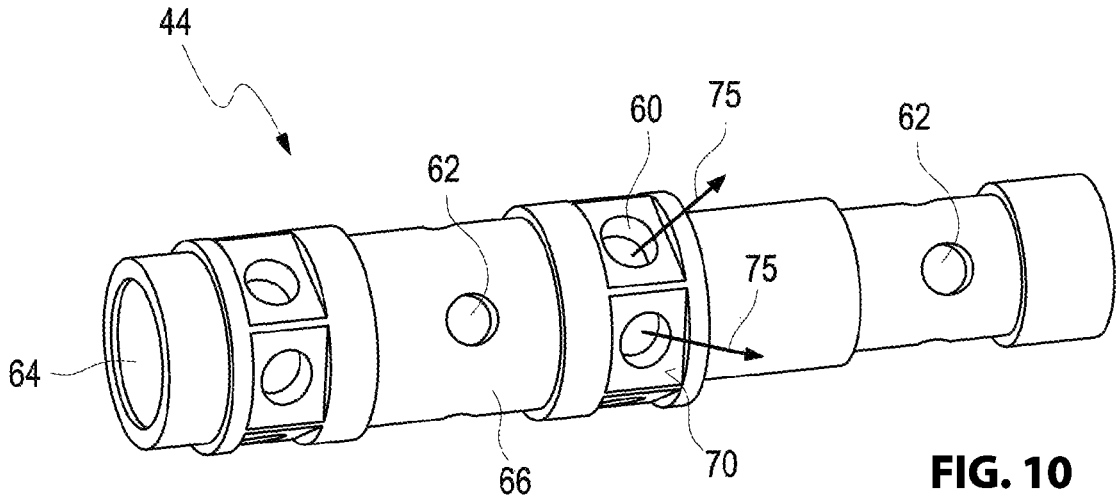
FIG. 10 illustrates a piston of a hydraulic valve according to another embodiment of the invention in an isometric view.

FIG. 10 illustrates a piston 44 of a hydraulic valve 12 according to another embodiment of the invention wherein the hydraulic supply of the bore holes 60 is provided in another manner. In this embodiment the outside 66 of the piston 44 in the portion of the bore holes 60 is configured as a flat surface 70 in particular portions. The flat surfaces 70 are respectively provided with identical surfaces so that pressure loading does not cause any undesirable movement of the piston 44.

Figure 11:
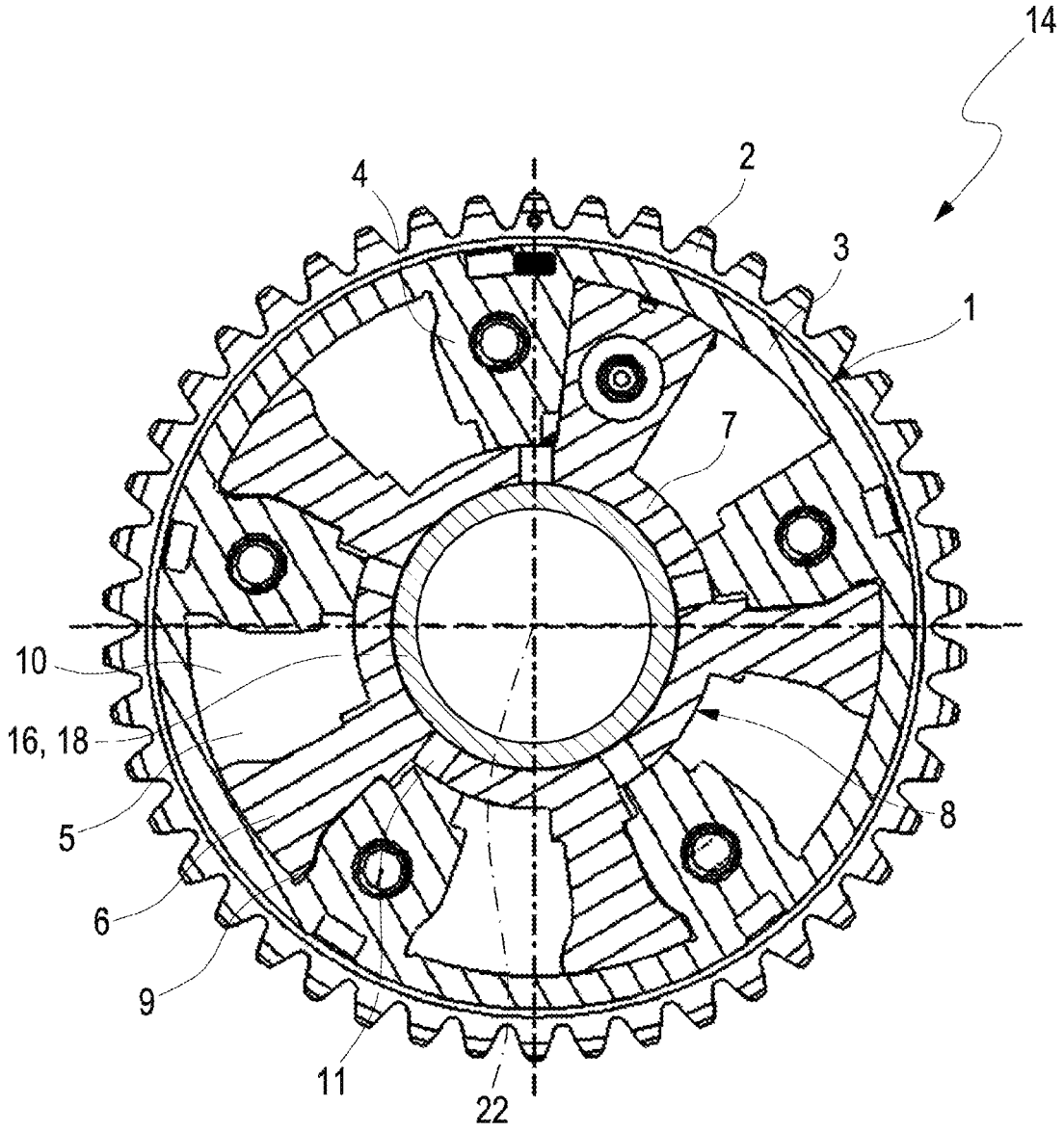
FIG. 11 illustrates a cam phaser according to an embodiment of the invention in a cross sectional view.

FIG. 11 illustrates a cam phaser 14 of a cam shaft 18 in a cross sectional view. The cam phaser 14 is provided to cooperate with a hydraulic valve 12 illustrated e.g. in FIGS. 1-3, wherein a first operating connection 34 is connected with a first pressure chamber 9 of the cam phaser 14 and a second operating connection is connected with a second pressure chamber 10 of the cam phaser 14. Thus, the first operating connection 34 and the second operating connection 36 are connectable by moving the piston 44 through at least one check valve 46, 48 as illustrated in FIGS. 4-6 alternatively with one another and/or with the supply connection 30 and/or with the at least one tank drain 48, 40. The at least one check valve 46, 48 is arranged in an inner portion of the piston 44. The check valve 46, 48 includes a band shaped flexible element 80 and releases a connection between an outside 66 and the piston 44 and an inner portion 64 of the piston 44 in an open position of the check valve 46, 48, wherein an inside 65 of the piston 44 includes an outer stop for the check valve 46, 48, so that the element 80 is openable in an inward direction by a hydraulic pressure provided at an outside 66 of the piston 44, in particular a pulsating hydraulic pressure.

A cam phaser 14 according to FIG. 11 is used to continuously adjust an angular position of the cam shaft 18 relative to the drive wheel 2 during operation of the internal combustion engine. Rotating the cam shaft 18 moves the opening and closing times of the gas control valves so that the internal combustion engine delivers optimum power at a respective speed. The cam phaser 14 includes a cylindrical stator 1 which is connected torque proof with the drive wheel 2. In the embodiment the drive wheel 2 is a chain sprocket over which a chain is run that is not illustrated in more detail. The drive sprocket 2 however can also be a drive belt that is used as a drive element. The stator 1 is operatively connected with the crank shaft through this drive element and the drive wheel 2.

The stator 1 includes a cylindrical stator base element 3 with bars 4 protruding from the stator base element 3 at an inside in a radially inward direction with uniform spacing. Intermediary spaces 5 are formed between adjacent bars 4 wherein a hydraulic fluid is introduced into the intermediary spaces for example through a hydraulic valve 12 that is illustrated in more detail in FIGS. 1-3. The hydraulic valve 12 is thus configured as a non-central valve but it can also be configured as a central valve in a particular embodiment. Between adjacent bars 4 blades 6 protrude which extend in a radially outward direction from a cylindrical rotor hub 7 of a rotor 8. The blades 6 divide the intermediary spaces 5 between the bars 4 respectively into two respective pressure chambers 9 and 10.

The bars 4 contact an outer enveloping surface of the rotor hub 7 with their faces in a sealing manner. The blades 6 contact in turn a cylindrical wall of the stator base element 3 with faces of the blades in a sealing manner.

The rotor 8 is connected torque proof with the cam shaft 18. In order to change an angular position between the cam shaft 18 and the drive wheel 2 the rotor 8 is rotated relative to the stator 1. Thus, hydraulic fluid in the pressure chambers 9 or 10 is pressurized as a function of a desired direction of rotation, whereas the other pressure chambers 10 or 9 are released towards the tank of the hydraulic fluid. In order to pivot the rotor 8 relative to the stator 1 counter clockwise into the illustrated position the hydraulic valve 12 pressurizes an annular first rotor channel in the rotor hub 7. From this first rotor channel additional channels 11 lead into the pressure chambers 10. This first rotor channel is associated with the first operating connection 34. In order to pivot the rotor 8 clockwise the hydraulic valve 12 pressurizes a second annular rotor channel in the rotor hub 7. This second rotor channel is associated with the second operating connection 36. The two rotor channels are axially offset from each other relative to a center axis 22.

The cam phaser 14 is placed onto the cam shaft 18 configured as a hollow tube 16. Thus, the rotor 8 is placed onto the cam shaft 18. The phaser 14 is pivotable by the hydraulic valve 12 illustrated in FIG. 2.

What is claimed is:

1. A hydraulic valve for a phaser of a cam shaft, the hydraulic valve comprising:

a bushing including a piston that is displaceable in a bore hole along a longitudinal direction;

a supply connection configured to supply a hydraulic fluid;

at least a first operating connection and a second operating connection; and at least one tank drain configured to drain the hydraulic fluid, wherein the first operating connection and the second operating connection are alternatively connectable with each other or with the supply connection or with the at least one tank drain through at least one check valve by displacing the piston, wherein the at least one check valve is arranged in an inner portion of the piston, wherein the at least one check valve includes a band shaped flexible element and releases a connection between an outside of the piston and the inner portion of the piston in an open position of the at least one check valve, and wherein an inside of the piston includes an outer stop for the at least one check valve so that the band shaped flexible element is openable in an inward direction by a hydraulic pressure provided at the outside of the piston, wherein the band shaped flexible element is secured against a displacement in the longitudinal direction by a fixation element axially enveloping the band shaped flexible element, wherein the at least one check valve is configured with at least one sleeve as an integrated unit, wherein the integrated unit includes the band shaped flexible element and the fixation element, wherein the at least one sleeve is inserted in a borehole of the piston, and wherein the band shaped flexible element contacts an inside of the sleeve with a preload.

2. The hydraulic valve according to claim 1, wherein a first check valve of the at least one check valve is associated with the first operating connection and a second check valve of the at least one check valve is associated with the second operating connection, and wherein the first check valve and the second check valve are arranged in the inner portion of the piston.

3. The hydraulic valve according to claim 2:

wherein a first operating position of the hydraulic valve is provided in which a first fluid path of the hydraulic fluid from the first operating connection through the first check valve associated with the first operating connection to the second operating connection is open, and wherein a second operating position is provided in which a second fluid path of the hydraulic fluid from the second operating connection through the second check valve associated with the second operating connection to the first operating connection is open.

4. The hydraulic valve according to claim 1, wherein a center position of the hydraulic valve is provided in which center position the first operating connection and the second operating connection are closed independently from the at least one check valve.

5. The hydraulic valve according to claim 1, wherein an additional fluid path of the hydraulic fluid is provided from the outside of the piston to the at least one check valve through bore holes in the piston.

6. The hydraulic valve according to claim 5, wherein a radial control groove at least partially extending on the outside of the piston is provided for supplying the bore holes with the hydraulic fluid.

7. The hydraulic valve according to claim 5, wherein the outside of the piston is respectively configured as a flat surface in a portion of the bore holes.

8. A hydraulic valve for a phaser of a cam shaft, the hydraulic valve comprising:

a bushing including a piston that is displaceable in a bore hole along a longitudinal direction;

a supply connection configured to supply a hydraulic fluid;

at least a first operating connection and a second operating connection; and at least one tank drain configured to drain the hydraulic fluid, wherein the first operating connection and the second operating connection are alternatively connectable with each other or with the supply connection or with the at least one tank drain through at least one check valve by displacing the piston, wherein the at least one check valve is arranged in an inner portion of the piston, wherein the at least one check valve includes a band shaped flexible element and releases a connection between an outside of the piston and the inner portion of the piston in an open position of the at least one check valve, and wherein an inside of the piston includes an outer stop for the at least one check valve so that the band shaped flexible element is openable in an inward direction by a hydraulic pressure provided at the outside of the piston, wherein the band shaped flexible element is arranged in a bore hole of the piston and secured against a displacement in the longitudinal direction by two separate annular fixation elements that are respectively pressed into the piston, wherein each of the two separate annular fixation elements secures the band shaped flexible element against the displacement in the longitudinal direction in an opposite direction.

9. A hydraulic valve for a phaser of a cam shaft, the hydraulic valve comprising:

a bushing including a piston that is displaceable in a bore hole along a longitudinal direction;

a supply connection configured to supply a hydraulic fluid;

at least a first operating connection and second operating connection; and at least one tank drain configured to drain the hydraulic fluid, wherein the first operating connection and the second operating connection are alternatively connectable with each other or with the supply connection or with the at least one tank drain through at least one check valve by displacing the piston, wherein the at least one check valve is arranged in an inner portion of the piston, wherein the at least one check valve includes a band shaped flexible element and releases a connection between an outside of the piston and the inner portion of the piston in an open position of the at least one check valve, and wherein an inside of the piston includes an outer stop for the at least one check valve so that the band shaped flexible element is openable in an inward direction by a hydraulic pressure provided at the outside of the piston, wherein the band shaped flexible element is secured against a displacement in the longitudinal direction by a fixation element axially enveloping the band shaped flexible element, wherein the fixation element is configured cylindrical or hollow cylindrical and includes two axially offset portions with radially extending protrusions, wherein the two axially offset portions are pressed into the piston, and wherein the band shaped flexible element is arranged about the fixation element and between the two axially offset portions and is axially fixated on the fixation element by the protrusions.

10. The hydraulic valve according to claim 1, wherein the fixation element forms a stop for the band shaped flexible element in the inward direction.

11. The hydraulic valve according to claim 9, wherein the radially extending protrusions are provided for supporting the at least one sleeve.

12. The hydraulic valve according to claim 1, wherein an additional check valve with a band shaped flexible element is provided at the supply connection within the piston, and wherein the additional check valve is openable in the inward direction by a hydraulic pressure provided at the supply connection.

13. A phaser for a cam shaft, the phaser comprising the hydraulic valve according to claim 1, wherein the first operating connection is connected with the first pressure chamber of the phaser and the second operating connection is connected with the second pressure chamber of the phaser.

14. A phaser for a cam shaft, the phaser comprising the hydraulic valve according to claim 8, wherein the first operating connection is connected with the first pressure chamber of the phaser and the second operating connection is connected with the second pressure chamber of the phaser.

15. A phaser for a cam shaft, the phaser comprising the hydraulic valve according to claim 9, wherein the first operating connection is connected with the first pressure chamber of the phaser and the second operating connection is connected with the second pressure chamber of the phaser.

* * * * *